United States Patent [19]

Sippola

[11] Patent Number: 4,759,807

[45] Date of Patent: Jul. 26, 1988

[54] METHOD FOR PRODUCING NON-AGING HOT-DIP GALVANIZED STEEL STRIP

[75] Inventor: Pertti J. Sippola, Espoo, Finland

[73] Assignee: Rasmet Ky, Helsinki, Finland

[21] Appl. No.: 946,817

[22] Filed: Dec. 29, 1986

[51] Int. Cl.[4] ..... C21D 1/48

[52] U.S. Cl. ..... 148/15; 148/142; 148/156; 427/433

[58] Field of Search ..... 148/15, 142, 155, 156, 148/611; 427/434.3, 435, 436, 383.7, 433

[56] References Cited

U.S. PATENT DOCUMENTS

| | | | |
|---|---|---|---|
| 3,837,790 | 9/1974 | Pierson | 266/111 |
| 4,165,964 | 8/1979 | Yonezawa et al. | 432/59 |
| 4,294,632 | 10/1981 | Kubota et al. | 148/142 |
| 4,361,448 | 11/1982 | Sippola | 148/15 |
| 4,364,728 | 12/1982 | Stamp | 432/8 |
| 4,575,053 | 3/1986 | Nakagawa et al. | 266/92 |

FOREIGN PATENT DOCUMENTS

| | | | |
|---|---|---|---|
| 36627 | 2/1985 | Japan | 266/103 |

*Primary Examiner*—Christopher W. Brody
*Attorney, Agent, or Firm*—Scully, Scott, Murphy & Presser

[57] ABSTRACT

The invention relates to a method for producing a non-aging hot-dip galvanized steel strip in a hot-dip galvanizing line with a continuous over-aging furnace at the end thereof. The steel strip is rapidly cooled from a temperature of 600° to 700° C. to a temperature of about 460° C. by quenching the steel strip in a zinc bath. Thereafter a steel strip is further cooled to a temperature preferably below 300° C. and the steel strip is then brought into the continuous over-aging furnace. The temperature of said furnace is about 350° C. and the over-aging treatment takes preferably from 2 to 3 minutes. A furnace has guide rolls arranged outside the furnace walls and the steel strip is momentarily cooled before making contact with a guide roll. After leaving the over-aging furnace, the steel strip is subjected to conventional air and water cooling as well as temper-rolling.

5 Claims, 3 Drawing Sheets

METHOD FOR PRODUCING NON-AGING HOT-DIP GALVANIZED STEEL STRIP

The requirements for formability of hot-dip galvanized cold-rolled steel have increased during the past few years, when users of plate (as, for example, the car industry), have gone over from using uncoated plates to using precoated plates. Hereby it is extremely important to master the aging properties of steel strip produced in continuous hot-dip galvanizing lines. The amount of solute carbon (and nitrogen) in the ferrite of a galvanized steel strip must not exceed 4 to 5 ppm, in order to achieve sufficiently good non-aging properties.

In the conventional (SENDZIMIR-type) hot-dip galvanizing method there is always, between the annealing treatment at 750° to 850° C. and zinc bath of about 455° C., a gas cooling stage, with a cooling rate of 10° to 50° C./ sec. After this treatment there is about 30 ppm solute carbon in the ferrite. When the aim is to achieve relatively good non-aging properties, the amount of solute carbon in the ferrite must be made to fall below 10 ppm.

A few hot-dip galvanizing lines are known, where a continuous over-aging furnace has been arranged after the zinc bath in order to achieve this aim. Because of the slow gas cooling the over-aging treatment of the steel strip requires a high temperature of about 375° C. and a long annealing time exceeding 3 minutes.

The main problems of these lines are:

zinc pick-up in the surface of the furnace rolls employed, causing defects in the surface of the steel strip, because of the long annealing time, the length of strip within the furnace is considerable, whereby it is difficult to keep the strip in the middle of the furnace line.

According to the present invention, the above difficulties are reduced and the non-aging properties are improved by lowering the temperature of the over-aging treatment to 300° to 350° C. This is achieved by using, instead of a slow gas cooling, a rapid cooling of the steel strip by quenching it from a temperature of 600° to 700° C. (usually about 650° C.) into a molten zinc bath, in accordance with U.S. Pat. No. 4,361,448. According to research work carried out the Aging Index of Al-killed steel, specified in Table 1, decreases considerably faster after a zinc quenching than after a slow gas cooling, as illustrated in FIG. 3. (Aging Index corresponds to the amount of solute carbon or/and nitrogen. If Al-killed steel hot band is coiled more than 700° C., then the Aging Index corresponds only to the solute carbon. The Aging Index was determined with tensile specimen at uniform deformation of 10 pct and after aging of 30 min at 100° C.).

TABLE 1

| Strip | Specification of Al-killed steel Chemical Compositions | | | Hot Band |
|---|---|---|---|---|
| Thickness | C | Mn | Si | Coiling Temp. |
| 0,7 mm | 0,02% | 0,2% | 0,01% | 720° C. |

In the following the invention will be described with reference to the accompanying drawing.

Figure 1:
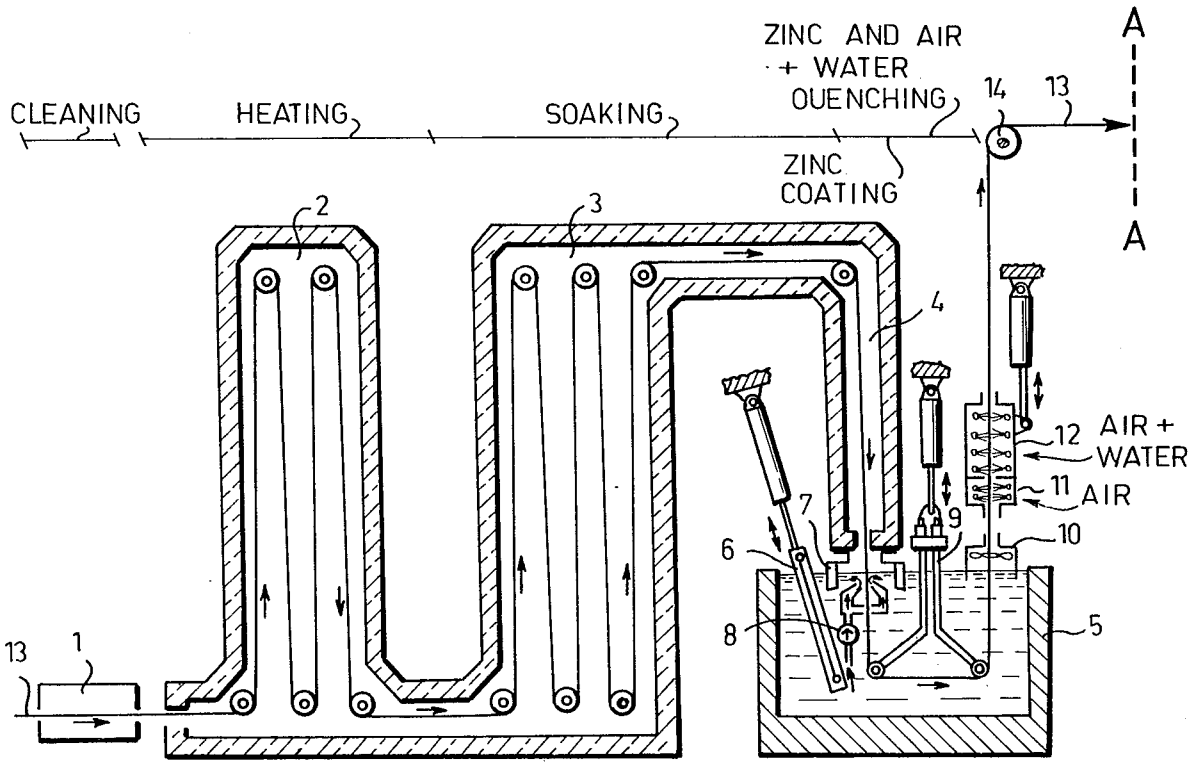
FIG. 1 shows schematically a hot-dip galvanizing line.

In FIG. 1 reference numeral 1 designates a unit for cleaning the steel strip from rolling oil. Numeral 2 indicates a furnace for heating the steel strip to the temperature range $A_1$ to $A_3$, 3 is a soaking furnace the last zone 4 whereof leads to a zinc-aluminium bath contained a pot 5. In the zinc-aluminium bath is arranged a cooling unit 6, a likewise cooled snout 7 of the chute from the soaking furnace to the zinc-aluminium bath, a pump unit 8 for circulating the melt and a guiding roll arrangement 9 guiding the steel strip through the zincaluminium bath. Numerals 10 and 11 indicate gas jet nozzles and numeral 12 indicates air-water blowing jets. The steel strip to be treated is designated numeral 13.

After cleaning the steel from rolling oil the strip 13 is heated in the furnace 2 containing a protective atmosphere to the temperature range $A_1$ to $A_3$ and annealing continues in the soaking furnace 3. The atmosphere gas may contain 10 to 25% hydrogen and 90 to 75% nitrogen. In the last zone 4 of the soaking-furnace the temperature of the steel is controlled to a temperature of 600° to 700° C. before quenching in the zinc-aluminium bath. The pot 5 is preferably ceramic and is provided with a cooling unit 6 or a heat exchanger to prevent the temperature of the zinc-aluminium bath from rising through the influence of the energy brought in by the steel strip. The molten metal is circulated by means of a pump 8 preferably provided with a ceramic turbine in such a way, that the molten metal flows evenly against the surface of the strip through nozzles arranged on both sides of the strip and extending over the whole width thereof. Hereby the temperature at that point of the metal bath stays constant in spite of the large amount of heat energy contained in the steel strip and at the same time the quenching effect of the molten zinc can be regulated by means of the flow rate of the molten zinc. When the speed of the steel strip changes the galvanizing time can be kept constant by regulating the height position of the pot rolls 9. This regulating can in manners well known as such be arranged to take place automatically depending on the speed of the strip. After the zinc bath the thickness of the coating is regulated by means of gas jet nozzles 10. Immediately after this the molten coating is rapidly solidified by means of cold air jets whereafter the steel strip is rapidly cooled preferably to a temperature below 350° C. by means of air-water blowing nozzles 12. The position of the cooling unit 11, 12 can be adjusted to different heights in accordance with the speed of the steel strip.

Figure 2:
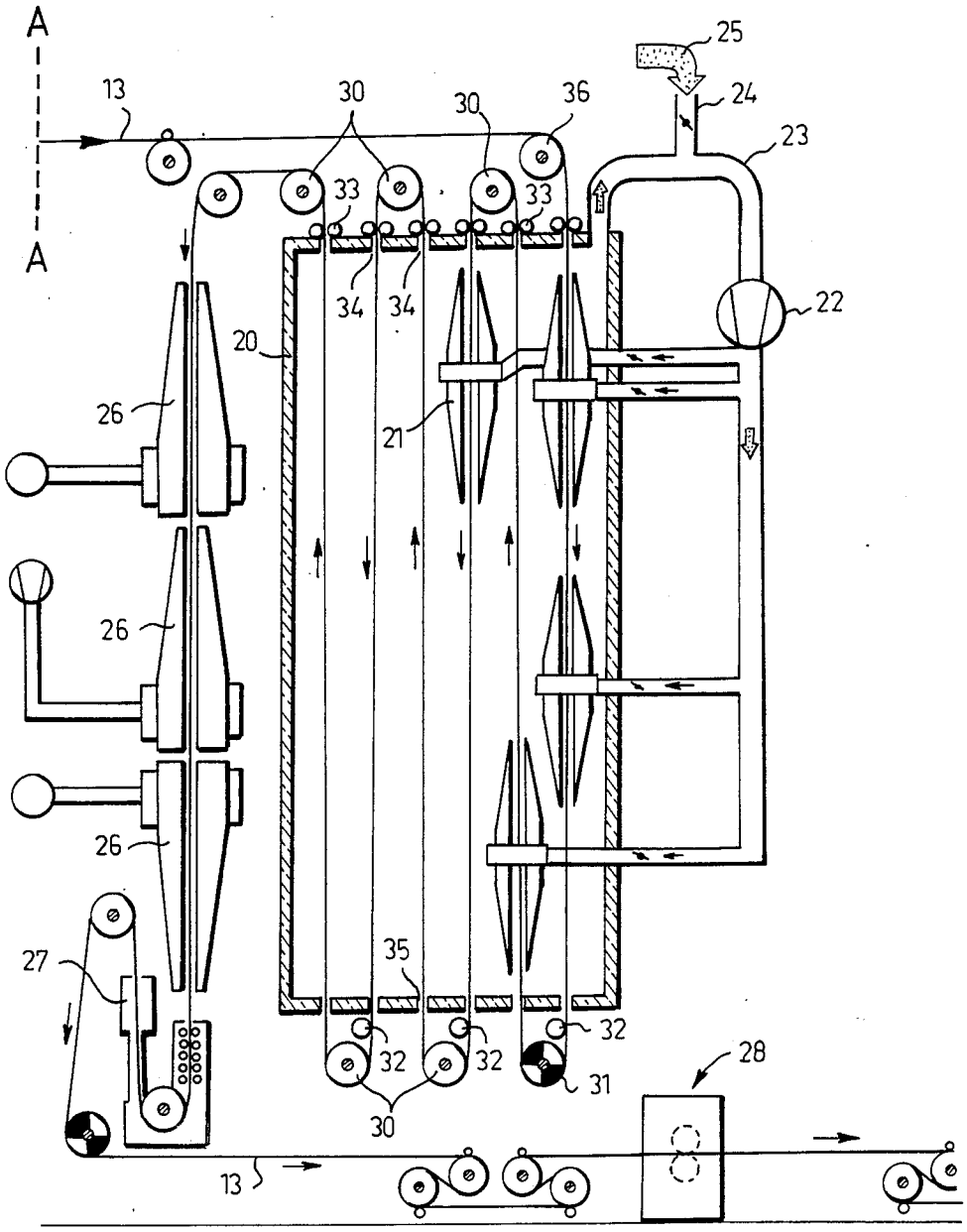
FIG. 2 shows schematically a preferred embodiment of an over-aging furnace to be arranged after the galvanizing line of FIG. 1.

FIG. 2 shows schematically an over-aging furnace following the galvanizing line of FIG. 1.

The over-aging furnace is designated 20. The temperature inside the furnace is in a range of 300° to 350° C. Conventional air nozzles directing air towards the steel strip within the furnace 20 are designated 21. A fan 22 circulates air through the furnace 20 and a tube 23. 24 indicates an intake for smoke gases (arrow 25) from the furnace of FIG. 1. The temperature of a smoke gas is approximately 600° C., and a correct amount of smoke gases in order to maintain a desired temperature within a furnace 20 is obtained by means of conventional temperature sensors and regulating means not shown in FIG. 2. Reference numerals 26, 27 and 28 indicate conventional air cooling means, water cooling means and a temper rolling arrangement, respectively, for treating the steel strip after the over-aging furnace 20. After a water cooling, at 27, a temperature of the steel strip 13 is generally not more than 50° C.

The novelty of the furnace 20 of FIG. 2 is to be seen in the arrangement of deflector rolls 30 and a steering roll 31, for centering the steel strip 13 during its travel through the furnace, outside the furnace.

One major advantage of this is that inspection and possible service (cleaning) of the furnace rolls can be carried out during production without stopping the line. The provision of a steering roll 31, of conventional type, is likewise easy.

Further major advantage of having the rolls 30 and 31 outside the furnace 20 is the possibility to provide cooling means (air or water) for momentarily cooling the steel strip before it contacts the rolls, in order to prevent the rolls from picking up zinc. This cooling means are indicated 32 at the bottom end of the furnace 20, and 33 at the top end. The cooling means 33 are preferably made as pairs of rolls contacting the steel strip from both sides and thereby also providing a seal for the openings 34 in the top wall of the furnace. The corresponding openings 35 in the furnace bottom wall need not be sealed.

The pick-up of zinc at the first deflector rolls (14, FIG. 1, and 36, FIG. 2) after the zinc bath is eliminated by cooling the steel strip to a temperature below 350° C., preferably to a temperature between 200° and 250° C. before roll 36. In addition, the temperature of the roll is considerably lower than that of the zinc coating of the steel strip. Thus, realizing that by placing the rolls of the continuous over-aging furnace outside the furnace, as shown in FIG. 2, and by keeping the temperature of the steel strip at a maximum of 350° C., it is possible to prevent the pick-up of zinc on the surface of the rolls. The additional cooling of the zinc coating, by either blowing a cold gas, at 32 or by cooled rolls 33 before the steel strip gets into contact with the surface of the rolls is not always necessary but still considered preferable.

By placing the rolls outside the furnace it is possible to provide a steering roll 31, whereby it is easier to keep the strip in the middle of the furnace line. From the point of view of operation it is very important that inspection and possible cleaning of the furnace rolls during production can be carried out without stopping the line (This is an indispensable condition).

Figure 3:
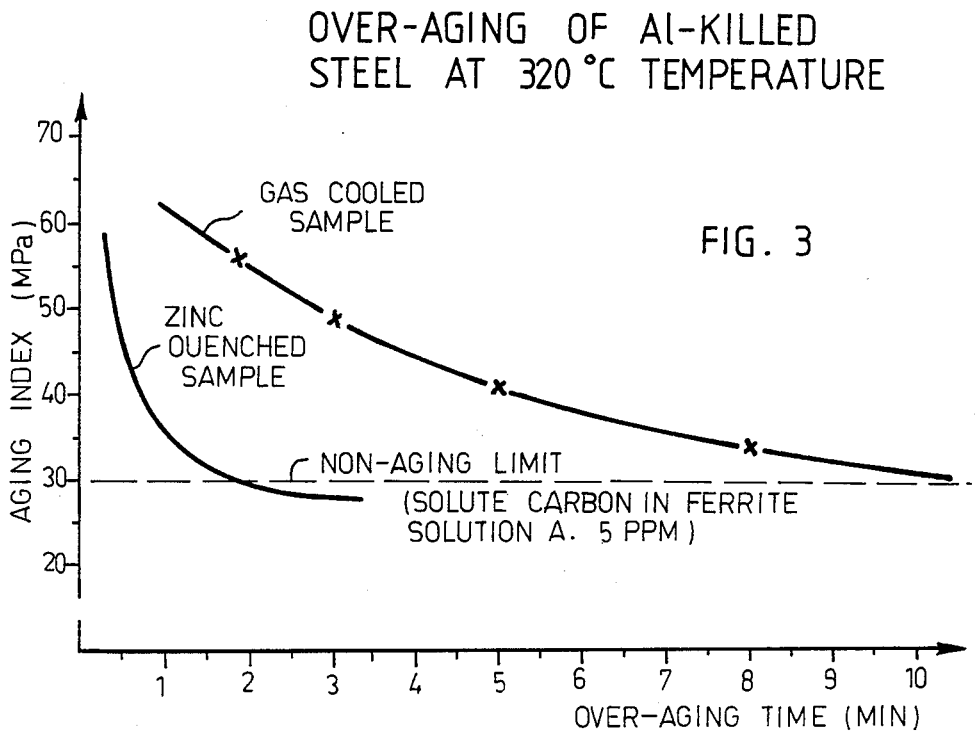
FIG. 3 is a diagram illustrating the difference between the present invention and the prior art.
Figure 4:
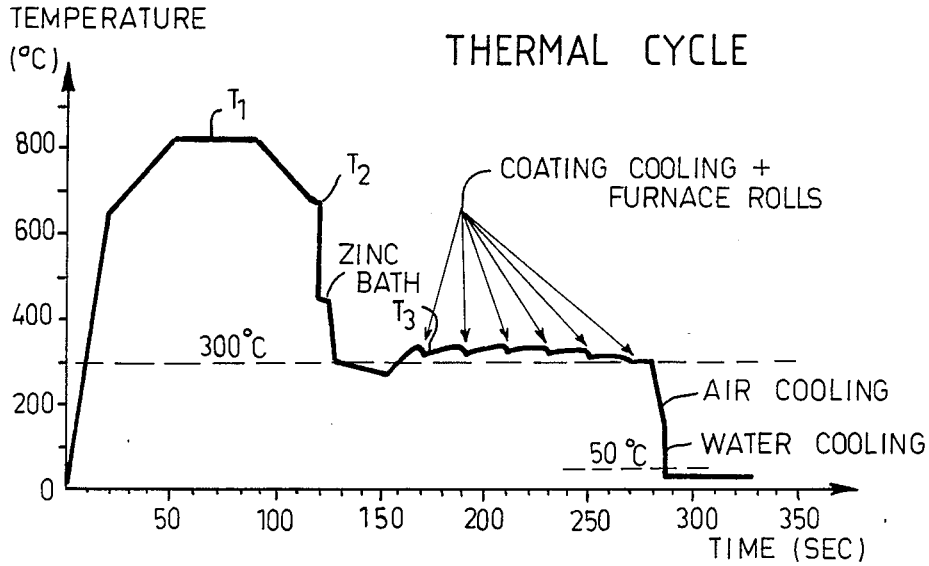
FIG. 4 is a diagram illustrating the thermal cycle of the present method.

FIG. 3 shows that by continuous over-aging zinc quench treatment during a time of 2 to 3 minutes it is possible to produce non-aging galvanized steel strip (AI-value below 30 MPa). A conventional slow gas cooling would demand a very long treatment time exceeding 10 minutes, which would be difficult to realize in practice.

The heat treatment profile of a non-aging hot-dip galvanized steel strip is shown in FIG. 3. After an annealing temperature ($T_1$=800° to 850° C.) the steel strip is gas cooled to a pre-quenching temperature ($T_2$=600° to 700° C.) before a rapid cooling of the steel in a zinc bath. After regulation of the thickness of the zinc coating the steel is further cooled, for example, to a temperature below 300° C. A steel strip galvanized in an continuous over-aging furnace is heated to and/or kept at a temperature $T_3$=300° to 350° C. for about 2 to 3 minutes. Before each furnace roll the zinc coating is cooled, whereby the temperature of the over-aging treatment becomes "wavelike". After the treatment the galvanized steel strip is cooled by air and water to a hall temperature below 50° C. before skinpass rolling.

I claim:

1. A method for producing a non-aging hot-dip galvanized steel strip in a hot-dip glavanizing line with a continuous over-aging furnace at the end thereof, wherein the steel strip is first heated to 800° to 850° C., annealed in a soaking furnace, and then controlled at a temperature of 600° to 700° C., comprising cooling the steel strip rapidly from a temperature of 600° to 700° C. by quenching the steel strip in a zinc bath, cooling the steel strip further after the zinc bath to a temperature not exceeding 300° C., and over-aging the thus glavanizd steel strip in the continuous over-aging furnace at a temperature not exceeding 350° C. for a period of one to three minutes.

2. A method according to claim 1, wherein the steel strip is quenched in a zinc bath to a temperature of about 460° C. during a time of maximum about one second.

3. A method according to claim 1, the continuous over-aging furnace having guide rolls for the steel strip, wherein the steel strip, during the over-aging treatment, is momentarily cooled before making contact with a guide roll, said guide rolls being mounted outside the furnace walls.

4. A method according to claim 3, wherein at least one steering roll, for centering the steel strip while moving through the furnace, is mounted outside the furnace walls.

5. A method according to claim 1, wherein the over-aging of the glavanized steel strip yields non-aging properties in accordance with an aging index of 30 MPa or less.

* * * * *